US005347906A

United States Patent [19]

Geiger

[11] Patent Number: 5,347,906

[45] Date of Patent: Sep. 20, 1994

[54] ADJUSTABLE STRINGED INSTRUMENT MUTE

[76] Inventor: John F. Geiger, 190 Berwick Dr. NE., Atlanta, Ga. 30328-1205

[21] Appl. No.: 151,276

[22] Filed: Nov. 12, 1993

[51] Int. Cl.[5] ..... G10D 1/10; G10D 3/04

[52] U.S. Cl. ..... 84/453; 84/273; 84/310; 181/207

[58] Field of Search ..... 84/453, 273, 310, 311, 84/267, 268, 269, 315, 316, 317, 318, 319; 181/207, 208, 209

[56] References Cited

U.S. PATENT DOCUMENTS

| | | | |
|---|---|---|---|
| 1,518,935 | 12/1924 | Kozelek | 84/453 |
| 1,622,469 | 5/1926 | Scott | 181/207 |
| 3,087,574 | 4/1963 | Watters | 181/207 |

*Primary Examiner*—Richard A. Wintercorn
*Assistant Examiner*—Cassandra C. Spyrou
*Attorney, Agent, or Firm*—Harry I. Leon; Vivian L. Steadman

[57] ABSTRACT

A mute for stringed instruments such as banjos, guitars, and the like which allows the volume of the sound generated by plucking the strings to be varied without changing the pitch of the instrument. This device comprises a small, elongated cloth bag filled with tiny metallic balls. The bag is sufficiently long that when it is properly mounted on the bridge of the instrument, the bag extends past the points where the two outermost strings cross the bridge, the two outermost strings being disposed proximate opposite ends of the bridge. In use, the beg is mounted partially on the upper edge of the bridge and partially on the strings. The degree of muting, as well as the duration of individual notes once played, varies with the position of the bag on the bridge. The pitch of the strings, however, does not vary. The mute works by absorbing some of the energy of the vibrating strings as first those balls in the bag which are closest to the strings are displaced by the strings and then transmit momentum to adjacent balls.

6 Claims, 2 Drawing Sheets

Fig. 1.
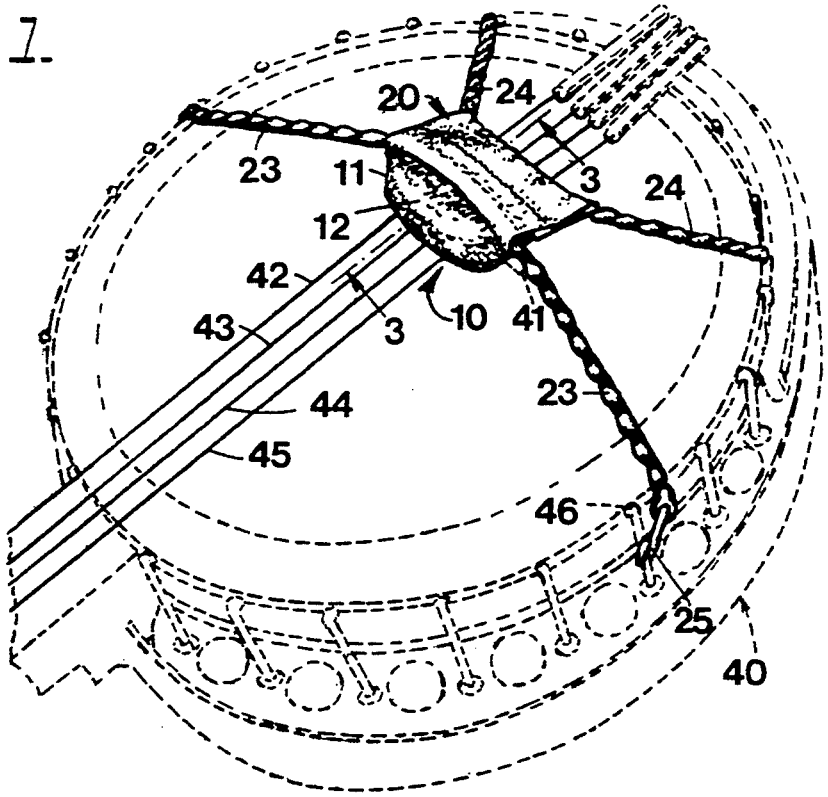
Fig. 2.
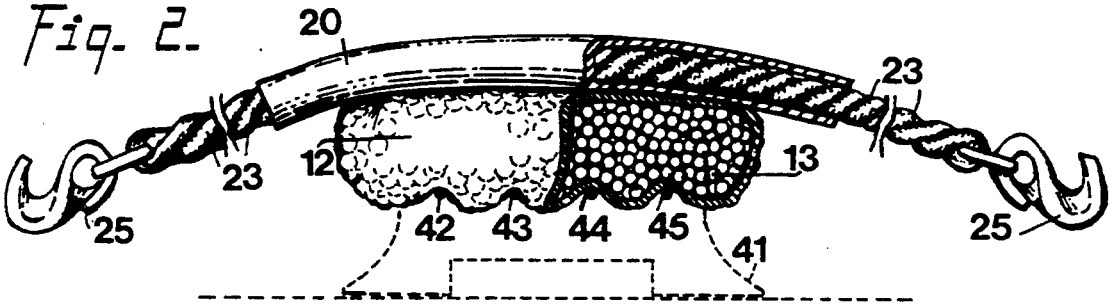
Fig. 3.
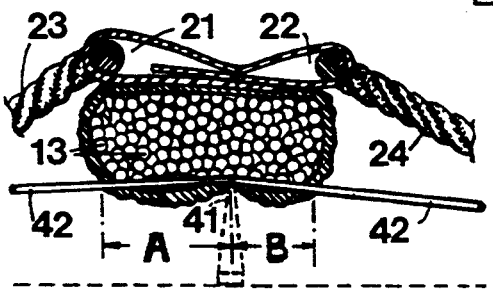
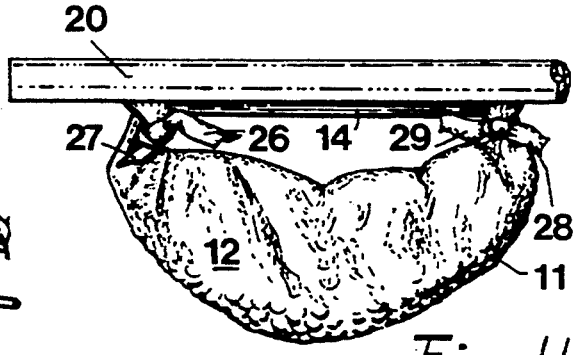
Fig. 4.

ADJUSTABLE STRINGED INSTRUMENT MUTE

BACKGROUND OF THE INVENTION

This invention relates to the field of stringed instruments and particularly to that segment relating to devices for muting the sounds of vibrating strings.

One of the earliest mutes for stringed instruments was disclosed by Kozelek, in U.S. Pat. No. 1,518,935, dated 1924. In use, Kozelek's mute, which is fabricated of a soft, pliable material composed of woven strands of wool, cotton, silk or the like, is positioned under the strings of a violin between its bridge and finger board. The tone of the instrument can be varied changing the position of the mute.

Schuh, U.S. Pat. No. 2,475,055, dated 1946, discloses a practice mute comprising a solid brass insert mountable over the bridge of a stringed instrument by wedging the insert onto the sides of the bridge. In overcoming the inertia of the dense brass mute, the bridge loses vibration energy, dampening the vibrations of the strings.

Si-hon, in U.S. Pat. No. 2,863,350, dated 1958, discloses a device having a soft, resilient tubing which can be pressed against the strings of an instrument to mute it.

Lemon, in U.S. Pat. No. 3,440,917, dated 1967, discloses a muting device also having a structure formed of a soft, resilient material but one which can be pressed downwardly and rearwardly against the strings of an instrument.

Rhodes, in U.S. Pat. No. 4,173,165, dated 1979, discloses a muting device having means for clamping the strings of an instrument between two layers of a soft, resilient material.

Jabolonski, in U.S. Pat. No. 4,667,560, dated 1987, closes a muting device mountable on the bridge of a stringed instrument, the device having a structure fabricated from a soft, resilient material in which are formed a plurality of spaced apart vertical slots for straddling the strings. In use, the sides each s lot contact one of the strings.

In general, the prior art teaches that a mute should neither bend the strings of an instrument nor touch its sound box. Otherwise, if the mute were to bend the strings, it would change the pitch of the instrument.

Moreover, to the applicant's knowledge, there is no prior art device which can be used to mute an acoustic guitar; nor is there any such device which can be used to mute a banjo without causing it, while muted, to sound like a guitar.

SUMMARY OF THE INVENTION

The object of this invention is to provide a low cost mute for providing a controllable amount of muting of a stringed instrument.

Another object of this invention to be provide a mute for a banjo which works in such a way that the tone of the banjo retains its unique qualities and does not sound like a guitar.

A further object of this invention is to provide a mute that can be placed on and removed from an instrument without bestowing any damage to the instrument or the bridge during the use of the mute or its installation or removal.

A still further object of this invention is to provide a mute which in use does not change the pitch of the instrument.

The device according to the present invention comprises a small, elongated bag of thin cloth filled with tiny spherical, metallic balls, and means, including a bag support and elastic straps engaged therewith, for securing the bag in position atop the bridge and strings of the instrument. When mounted thereon for use, portions of the bag, each such portion containing some of the balls, protrude downwardly on both sides of each of the strings and towards the sound box of the instrument. Because the bag is made of a thin, flexible material, the balls not only surround each of the strings within an arc greater than 180 degrees but also are direct contact with the cloth where it touches the tops and sides of the strings.

In use, as one or more of the strings is stroked or plucked and starts to vibrate, the vibrating string causes the balls which are disposed next to it to vibrate sympathetically. The energy of the vibrating string is then quickly passed to other balls in the bag and dissipated. The amount of energy dissipated appears to depend upon the number of balls in direct contact with the cloth where it touches the strings. At least, it has been experimentally that the muting effect from the device becomes greater as more of the bag is placed on the vibrating strings. However, the bag, even with the balls compacted therein, normally cannot be placed entirely in front of the bridge without changing the pitch of the instrument. The muting effect can also be enhanced by increasing the downward force of the bag on the strings by changing the position of the bag support so as to increase the downward component of the force exerted, on the support, by the elastic bands, both of which are part of the means securing the bag atop the strings and bridge.

The position of the bag relative to the bridge effects not only the amount of muting but also the duration of a note played on the instrument. In general, when the greater part of the bag is positioned in front of the bridge, the amount of muting greater; but when the greater part of the bag is positioned to the rear of the bridge, the duration or sustainability of a note is enhanced. The ideal location of the bag for most applications is to have it partially resting on the bridge and the strings in front of the bridge and partially resting on any strings behind the bridge.

The amount of muting is often be increased or decreased very easily by repositioning the muting device with a quick brush of the back of the hand. The muting effect cam be greatly reduced or eliminated entirely by moving the mute behind the bridge, depending upon the instrument.

BRIEF DESCRIPTION OF THE DRAWINGS

FIG. 1 is a perspective view of the mute according to the present invention placed in position for use on a banjo, the banjo, except for its strings, being shown in dashed lines;

FIG. 2 is a frontal elevation view showing fragmentary portions of the mute according to FIG. 1, the mute being shown mounted on the bridge of a banjo but with the elastic bands for securing the mute to the sides of the banjo unattached;

FIG. 3 is a cross-section 3—3 according to FIG. 1;

FIG. 4 is an elevation view showing the bag and a fragmentary portion of the bag support of the mute according to the present invention, the bag being suspended from the support to show the ties which secure the bag to the underside of the support.

DETAILED DESCRIPTION OF THE PREFERRED EMBODIMENT

Figure 5:
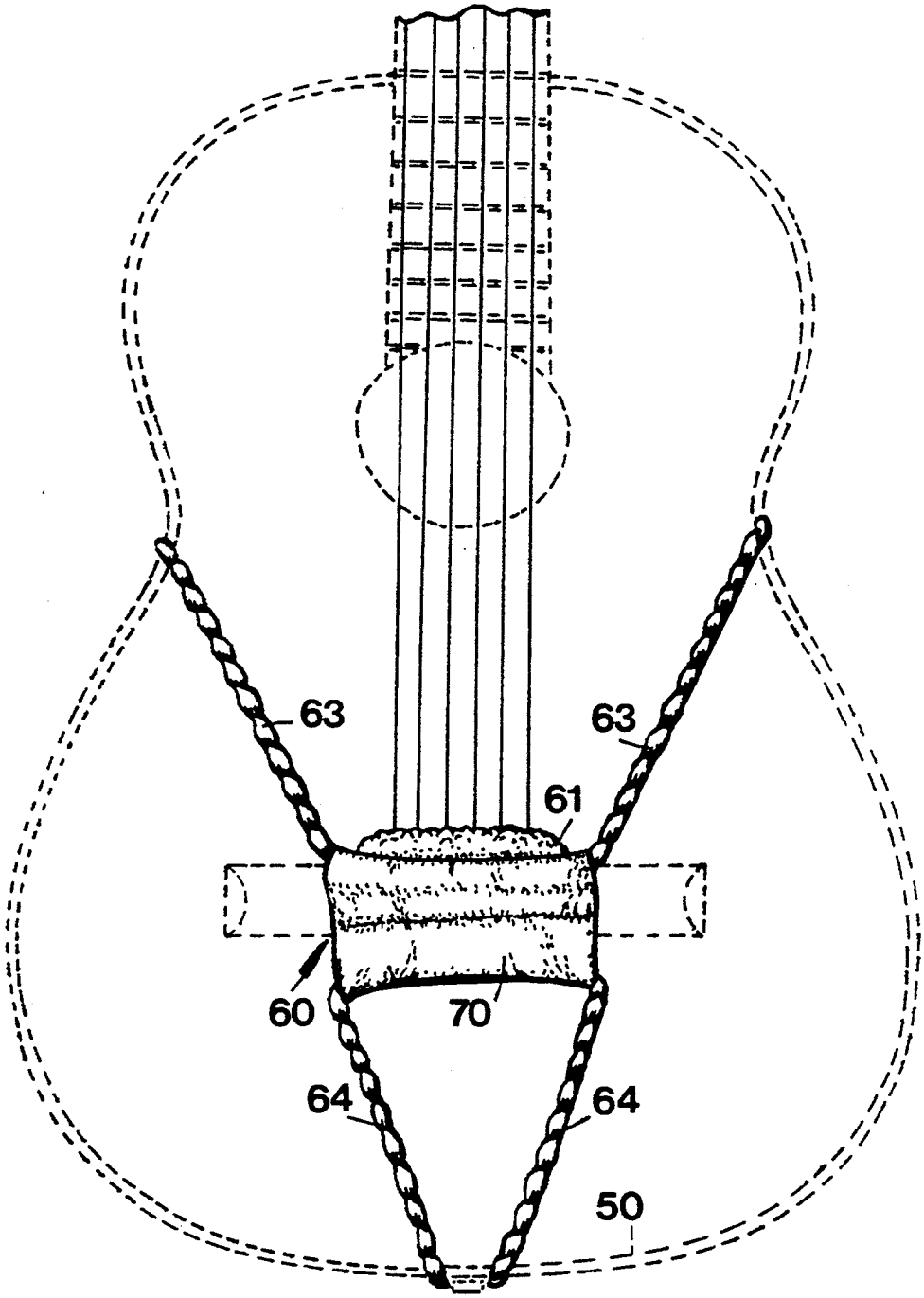
FIG. 5 is a plan view of an alternate embodiment of the mute according to the present invention for use on a guitar.

A muting device, which is referred to generally herein by the numeral 10, comprises three major components: an elongated bag 11, a bag support 20, and means, including elastic bands 23, 24 connected to the support, for holding the bag in place on a stringed instrument such as a banjo 40 or a guitar 50.

Made from at least one layer of a thin, lightweight, abrasion-resistant cloth 12 or similar material, such as a flexibly nylon or plastic, the bag 11 is filled with a plurality of tiny spherical, metallic balls 13. In the preferred embodiment, the bag 11 comprises two layers of a fine mesh nylon such as ripstop parachute canopy material and has a thickness which measures, by way of example, about 0.0025 inch. The balls 13 filling the bag 11 are preferably zinc-coated steel in composition and measure about 4.5 mm in diameter. Such balls are commonly used as pellets in air guns. Alternately, spherically-shaped balls formed of chromium steel or the like and ranging in size from 1/16 inch to ¼ in diameter can be utilized. However, mutes utilizing 4.5 mm, zinc-coated steel balls have been found experimentally to give sound of higher quality than did chromium steel balls of any of the sizes tested, including 1/16 inch, ⅛ inch and ¼ inch diameter balls.

The dimensions of the bag 11 recommended for use with a particular stringed instrument depend, in part, upon the span between the two strings situated furthest apart from each other as they cross the bridge. The bag 11 is sized so that it is between about 1 inch and 1¼ inches longer than this span. A bag 11 which extends ⅝ inch on either side of the bridge beyond the two outermost strings defining this span was found to provide the best sound.

When the bag 11 has sufficient width in transverse cross-section, the mute 10 can be used both to dampen the volume of sound coming from a stringed instrument and to increase the duration, known in the art as the "sustain", of a note once it has been played. In general, a greater extension of the bag 11 having contact with the strings 42, 43, 44, 45 forward of the bridge 41 results in a greater degree of muting. A higher degree of "sustain", on the other hand, can be achieved by positioning the bag 11 so that more of its body is disposed rearwardly of the bridge. As illustrated in FIG. 3, the mute 10 is preferably mounted on the bridge 41 of a banjo 40 in such a way that the forward extension A is between 1 and 2 times are long as the rearward extension B.

When intended for use as a mute on a four-string banjo, the bag 11 preferably measures about 2⅝ inches in length by 1⅞ inches across in transverse cross-section and is filled with approximately 335 of the 4.5 ram, zinc-coated steel balls. Alternately, when the chromium steel balls are substituted for the zinc-coated steel balls, 800 of the 1/16 inch diameter balls, 675 of the ⅛ inch diameter balls, or 150 of the ¼ inch diameter balls are needed to fill a bag 11 of these dimensions. On the other hand when a mute 60, otherwise similar in function to the mute 10 but intended for use as a mute on a six-string guitar, the bag 61 preferably measures about 3 inches in length.

As is best seen in FIG. 4, the bag 11 includes a closure which is made into a loop 14 for use in attaching the bag to the bag support 20. To attach the bag 11 to the support 20, at least one member of each of two pairs of ties 26, 27; 28, 29 sewed to the support is inserted through the loop 14 and attached to the other member of the pair, thereby tying the bag to the support and providing some flexibility in the attachment of the bag thereto.

The bag support 20 comprises a bifurcated tubular structure fabricated from a heavy cloth material such as canvas or the like. The tubular structure measures, by way of example, about 3 inches in length by 1¾ inches in width. The support 20 has at least two elongated passageways 21, 22 through which elastic straps 23, 24, respectively, are threaded. Each strap 23, 24 protrudes from opposite ends of the passageway 21, 22 through which the strap extends. For ease of securing the support 20 on a stringed instrument, each end of each of the straps 23, 24 has a small hook 25 affixed thereto. As is best seen in FIG. 1, the hooks 25 can be secured to rungs 46 disposed along the sides of a banjo 40. Alternately, in the mute 60, elastic straps 63, 64 extend from opposite ends of elongated channels (not shown) defined by a bag support 70; hooks 25 affixed to both ends of each strap are interlocked with each other to secure the mute in position for use with a guitar 50 (FIG. 5).

It is understood that those skilled in the art may conceive other applications, modifications and/or changes in the invention described above. Any such applications, modifications or changes which fall within the purview of the description are intended to be illustrative and not intended to be limitative, The scope of the invention is limited only by the scope of the claims appended hereto.

It is claimed:

1. A muting device for stringed instruments in which sound is generated by displacing at least one string stretched across a bridge, comprising:

(a) a plurality of hard, spherically shaped solids;

(b) an elongated, sealed bag fabricated from a thin, flexible material, the bag being filled with the solids; and (c) means for supporting the bag so that a portion of the bag can be held in contact with said at least one string in close proximity to the bridge.

2. A muting device according to claim 1 which further comprises a loop connected to both ends of the bag and wherein the supporting means is attached to the loop, the bag being movable about the supporting means when attached to the loop, so that the bag can be easily repositioned relative to the bridge.

3. A muting device for stringed instruments having a sound box and a bridge in which sound is generated by displacing at least one string stretched across the bridge, comprising:

(a) a plurality of tiny, spherically-shaped metal balls;

(b) an elongated, sealed bag having a cover fabricated from a thin, flexible material, the bag being filled with the balls; and (c) means for supporting the bag so that the bag can be held in contact with said at least on string in close proximity to the bridge, portions of the bag protruding downwardly on both sides of said at least one string and towards the sound box, each of said portion containing an amount of balls which are in direct contact with the cover contiguous with points where the cover of the bag touches the string.

4. A method for altering the sound coming from stringed instruments having a sound box and a bridge in which sound is generated by displacing at least one string stretched across the bridge, comprising mounting, atop the bridge and in contact with said at least one string in close proximity thereto, an elongated, sealed bag having a cover fabricated from a thin, flexible material, the bag being filled with a plurality of small, spherically-shaped metal balls, portions of the bag protruding downwardly on both sides of said at least one string and towards the sound box, each of said portions containing an amount of said balls which are in direct contact with the cover contiguous with points where the cover of the bag touches the string.

5. The method according to claim 4 which further comprises positioning the bag so that more of the bag in transverse cross-section extends forwardly of the bridge than extends rearwardly thereof, thereby reducing the voluble of sound generated.

6. The method according to claim 4 which further comprises positioning the bag so that more of the bag in transverse cross-section extends rearwardly of the bridge than extends forwardly thereof, thereby enhancing duration of notes played on the instrument.

* * * * *